United States Patent [19]

Furgal et al.

[11] 4,014,105

[45] Mar. 29, 1977

[54] ARTICLE, APPARATUS AND METHOD FOR CONDITIONING FIBROUS MATERIALS WITH LIQUID CONDITIONING COMPOSITION

[75] Inventors: Henry P. Furgal, Bernardsville; Ingrid A. Larsen, Cranbury, both of N.J.

[73] Assignee: Colgate-Palmolive Company, New York, N.Y.

[22] Filed: Mar. 2, 1973

[21] Appl. No.: 337,352

Related U.S. Application Data

[63] Continuation of Ser. No. 82,313, Oct. 20, 1970, abandoned.

[52] U.S. Cl. ..... 34/12; 34/60; 118/76; 427/242

[51] Int. Cl.[2] ..... F26B 7/00

[58] Field of Search ..... 117/109, 120, 119.8, 117/139.5 CQ; 34/45, 60, 133, 12; 427/242

[56] References Cited

UNITED STATES PATENTS

| | | | |
|---|---|---|---|
| 2,851,791 | 9/1958 | Olthuis | 34/90 |
| 2,941,309 | 6/1960 | Cobb | 34/12 X |
| 3,215,311 | 11/1965 | Nison et al. | 34/60 X |
| 3,442,692 | 5/1969 | Gaiser | 117/120 |
| 3,633,538 | 1/1972 | Hoeflin | 118/76 |
| 3,634,947 | 1/1972 | Furgal | 34/60 |
| 3,676,199 | 7/1972 | Hewitt et al. | 34/12 |

FOREIGN PATENTS OR APPLICATIONS

| | | | |
|---|---|---|---|
| 772,888 | 12/1967 | Canada | 34/60 |

*Primary Examiner*—Carroll B. Dority, Jr.
*Attorney, Agent, or Firm*—Norman Blumenkopf; Murray M. Grill; Herbert S. Sylvester

[57] ABSTRACT

An article for conditioning fibrous materials includes a dispensing container of liquid fabric conditioning composition which has an opening in the wall thereof through which the conditioning composition is gradually dispensed into contact with fibrous materials to be conditioned. The conditioning composition is usually an aqueous solution of a surface active synthetic organic anionic, nonionic or cationic fabric conditioning agent, which is a softening agent that usually also makes the treated fabrics non-static. The container of conditioning composition usually includes a plurality of small dispensing openings therein and the viscosity of the solution of conditioning agent may be such that dispensing is preventable until the container comes into contact with materials to be treated or is subjected to shocks, as in tumbling of the container in contact with laundry being dried in an automatic laundry dryer. A preferred form of the container is a polypropylene sphere, having a separate larger filling opening and a closure therefor.

Also disclosed are an apparatus including an automatic laundry dryer or similar machine and the disclosed dispensing container of conditioning agent, and methods for conditioning fabrics and laundry utilizing such article and apparatus.

4 Claims, 6 Drawing Figures

INVENTORS
HENRY P. FURGAL
INGRID A. LARSEN
BY
Norman Blumenkopf
ATTORNEY

ARTICLE, APPARATUS AND METHOD FOR CONDITIONING FIBROUS MATERIALS WITH LIQUID CONDITIONING COMPOSITION

This is a continuation of application Ser. No. 82,313, filed Oct. 20, 1970, and now abandoned.

SUBJECT OF THE INVENTION

This invention relates to the conditioning of fibrous materials, such as fabrics and articles made from them, with solutions of conditioning agents. It also relates to articles, apparatuses and methods for accomplishing such conditioning. More particularly, the invention is of the use of a container of conditioning solution, such as a fabric softener and/or antistatic agent, which may be tumbled with laundry being conditioned in an automatic dryer and which discharges solution of conditioning agent through perforations in the container, so that the agent is applied to the laundry and conditions it. Such application of conditioning agent is carried out concurrently with drying of the laundry.

BACKGROUND OF THE INVENTION

The treatment of fibers, fabrics and laundry with conditioning agents, such as fabric softeners, anti-wrinkling agents, antistatic compounds and other preparations designed to improve the properties of the treated material is a well-known operation. It is practiced most by the housewife who adds fabric softening solution in the final rinse cycle of an automatic washing machine. The substantive cationic softening agent usually employed strongly adheres to the laundered textiles and remains thereon during subsequent spin drying and heat drying. Of course, such processes require that the conditioning agents employed be highly substantive or else they will be removed with the rinse water, yielding insufficient softening activities.

In efforts to find other ways of depositing softening agents on the surfaces of fibers and fabrics, pressurized sprays have been applied to the articles to be treated either before or after drying. Even when the sprays are of very fine droplets of a solution of conditioning agent it is a tedious task to apply the spray evenly to all the articles being treated. When the spraying apparatus is included as an integral part of a drying apparatus, such as an automatic laundry dryer, the costs of the spraying apparatus, control means for it and installations of these are often so great as to make such a treatment uneconomical. Instead of using a spray, solid conditioning agents, absorbed onto or impregnated into flexible papers, cloths or sponges have been employed in the dryer. U.S. pat. No. 3,442,692 teaches that substantive cationic conditioning compounds vaporize into the moist atmosphere of the dryer and are sorbed by the materials being tumbled therein. Although it is considered that many useful cationic conditioning agents are of such high boiling points that they are incapable of vaporizing under ordinary drying conditions, U.S. Pat. No. 3,442,692 is cited as an example of another way to use conditioning agents in the automatic laundry dryer.

Although the disadvantages of conventional softening methods, utilizing the washing machine, and more recently developed treating operations, using the automatic laundry dryer, are known, before the present invention there was no acceptable simple and economical way to apply liquid conditioning agent to fabrics to be softened or to be made antistatic in the automatic laundry dryer. Now, by following the method of this invention, good conditioning may be obtained economically and conveniently and without the necessity for the installation of complex equipment.

DESCRIPTION OF THE INVENTION

In accordance with the present invention there is provided an article for use in the conditioning of fibrous materials which comprises a dispensing container for a liquid fabric conditioning composition, liquid fabric conditioning composition in the container and an opening in the container through which said conditioning composition is dispensed into contact with fibrous materials to be conditioned. The dispensing of conditioning composition is gradual, so as to apply it in a well distributed pattern over the surfaces of the various materials to be conditioned. To accomplish such dispensing there will normally be employed a plurality of comparatively small openings in the dispensing container and the viscosity of the solution of conditioning agent may be such that the desired rate of release of the liquid from the container is obtained. Also within the invention are apparatuses including automatic laundry dryers or equivalent structures and the present article or articles. Methods of utilizing the articles and apparatuses to effect softening also constitute important parts of the invention.

Various details, constructions, operations, uses and advantages of the invention will be apparent from the following description, taken in conjunction with the illustrative drawing of some embodiments thereof, in which drawing:

THE DRAWING

DETAILED DESCRIPTION OF THE INVENTION

Figure 1:
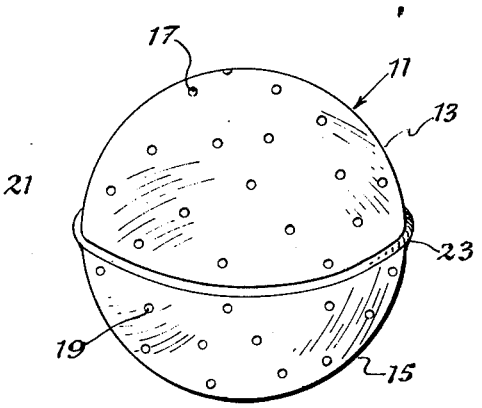
FIG. 1 is a perspective view of an article of the present invention, illustrating a distribution of dispensing openings over substantially the entire surface of the article.
Figure 2:
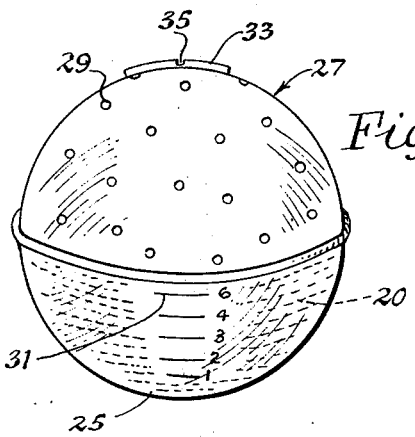
FIG. 2 is a perspective view of a similar article, but with dispensing openings located on only an upper portion of the surface thereof.

As shown in FIG. 1, dispensing container 11, for fabric softener or other conditioning liquid, comprises hemispherical portions 13 and 15, each of which is perforated with small dispensing openings designated by 17 and 19, respectively. The upper hemisphere has an internally threaded end 21 and the lower portion of the hemisphere has an externally threaded end 23, which enable them to be joined together to form a sphere. The material of construction of the sphere is preferably a resilient plastic such as polyethylene or polypropylene, which is sufficiently heat stable at the temperature of operation to maintain the spherical form, while allowing some temporary distortions during tumbling, which facilitate dispensing of conditioning material through perforations 17 and 19. Desirably, perforations 19, in the lower portion of the sphere, are of such size as to prevent the conditioning liquid from being leaked out through them while the container is stationary and out of contact with other materials but if conditions warrant or more rapid dispensing is desired, the apertures may be large enough so that liquid can drip of flow through them or some of them even when the dispenser is not being tumbled. To prevent any leakage on storage or before intended use, under all conditions of viscosity and surface tension of the conditioning liquid, as is shown in FIG. 2, the lower portion 25 of another dispenser 27 is unperforated. Dispensing openings 29 in the upper portion thereof are small and are circular in shape. The lower part of the sphere contains indicia 31 to aid in the measurement of the content of conditioning liquid 20. Threaded cap 33 having a notch 35 fits the sphere and provides an enlarged filling opening, when removed. The rest of the container is of unitary construction.

Figure 3:
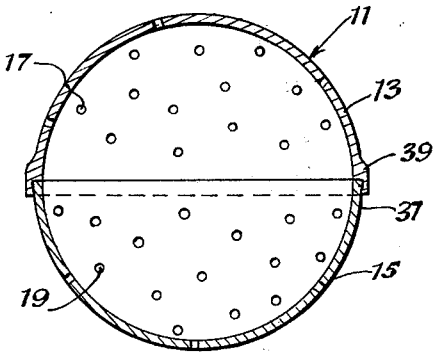
FIG. 3 is a central vertical section of the article of FIG. 1.

The internal construction of the conditioning article of FIG. 1 is shown in FIG. 3. However, instead of threaded joinder of the hemispheres, a frictional or snap joinder is indicated wherein a smaller portion 37 on lower hemisphere 15 fits into an enlarged portion 39 of hemisphere 13. A frictional fit may result there or, if desired, a ring may be provided on portion 37 to snap fit into a recess on portion 39. In either this case or with the structures shown in FIGS. 1 and 2, the thicknesses of hemispheres 13 and 15 should be sufficient to make the hemispheres form-maintaining enough to form tight closures and prevent leakage of conditioning fluid at the line of joinder.

Figure 4:
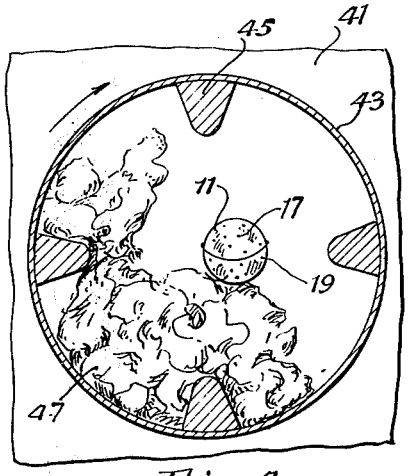
FIG. 4 is a view of the interior of an automatic laundry dryer containing laundry to be conditioned and illustrating the conditioning article of FIG. 1 in tumbling contact with such laundry.

In FIG. 4 an automatic laundry dryer 41 includes a horizontally rotating tumbling drum 43 which has baffles or internal projections 45 therein to assist in raising up laundry articles 47 as the drum rotates in a clockwise direction. Inside the drum is shown a fabric conditioning dispensing article 11, through the perforations 17 and 19 of which fabric conditioning liquid is discharged into contact with laundry or other fibrous materials to be treated. Such contact is effected by gravity or inertial discharge of liquid as the movement of the ball is halted when it contacts the laundry or by capillary action when the laundry contacts the liquid through an aperture in the dispenser. As the laundry containing the surface deposit of conditioning liquid continues to tumble with other materials, some of the conditioning liquid is transferred to them, especially in those cases wherein the conditioner is not strongly substantive to fibers of the laundry. Means for rotating the tumbling drum, heating air, blowing the air through the drum and exhausting it with moisture removed from the clothing are conventional and are not illustrated.

Figure 6:
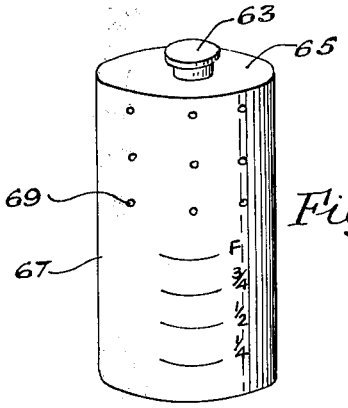
FIG. 6 is a perspective view of another conditioning article, of different shape and with a different distribution of dispensing openings.
Figure 5:
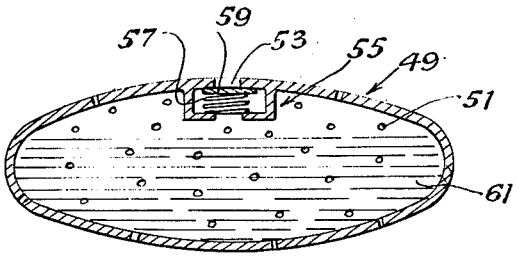
FIG. 5 is a central vertical section of an ellipsoidally shaped conditioning article of this invention, showing a spring-loaded dispensing opening.

In FIGS. 5 and 6 are shown other shapes of dispensing articles of the invention, that of FIG. 5 being ellipsoidal and that of FIG. 6 being cylindrical. Ellipsoidal dispenser 49 has perforations 51 over the surface thereof and includes a dispensing opening 53 closed by a spring loaded valve 55. The spring of the valve is sufficiently strong to prevent leakage when the article is not subjected to shocks but when dropped inside the dryer, as the drum rotates, the spring 57, which may have a weight attached to it to increase inertial forces, is moved away from opening 53 and closure member 59 moves downwardly, allowing passage of conditioning liquid 61 through the opening created. In FIG. 6, a screw cap 63 closes an opening in an end 65 of cylindrical container 67. Perforations 69 allow dispensing in use and the opening closed by cap 63 allows easy filling of conditioning liquid.

The dispensing container may be made of any suitable material for holding the composition to be applied to the laundry, fabrics or fibers to be conditioned. Thus, metal, mineral, rubber, synthetic organic polymeric plastic and suitable material of animal and vegetable derivation, such as modified or treated cellulosic or proteinaceous material can be employed. Of these, however, it is much preferred to utilize synthetic organic plastic materials or suitable rubbers which can withstand dryer heat, since they can be made with desired wall thicknesses, can have dispensing openings or other closures molded or readily formed in them, are economical to manufacture, may be produced in a wide variety of shapes and forms, are aesthetically pleasing to the consumer and can be engineered to possess a desired degree of resilience or flexibility, although they are essentially form-maintaining, even after temporary distortions.

Of the polymeric materials that may be employed those most preferred are the poly-lower alkylenes, such as polypropylene and polyethylene, either of high or low density, as the situation indicates. In addition to these poly-lower alkylene materials, one may also use other suitable synthetics such as polyesters, especially glass fiber reinforced polyesters, polyvinyl chloride, nylons, polyurethanes, either flexible or rigid, and polystyrene. The polyurethanes and polystyrenes may sometimes be desirably employed as foams, either rigid or somewhat flexible. Rubbers, such as natural rubber, neoprene, Buna-S and other rubbers or rubber-like materials which can withstand dryer temperatures being employed are also useful. Such materials may be pure or may contain suitable plasticizers, coloring agents, etc. They may be printed with designs, indicia or instructions. Often it will be preferred to use those which are transparent or at least, translucent, so as to show the contents of material still in the container during or at the cessation of a conditioning operation.

As is illustrated in the drawing, the container may be of any suitable shape, although for purpose of best transfer of conditioning agent to fabrics or laundry it has been found that curved shapes are preferable. These seem to make a better rolling contact with the articles being treated and thus, allow better distribution of the dispensed conditioning agent at the time at which it first contacts the articles being treated. Of the various shapes which are usable, the spherical is preferred, although other completely convexly curved articles are also very useful. Sharp edged or concave structures are usually to be avoided but may be acceptable in some cases. Thus, preferred shapes include spheres, ellipsoids, cylinders, especially those having rounded ends, twin paraboloids or hyperboloids, joined at their larger ends and similar forms. Exterior surfaces will usually be smooth but may be rough, spongy or irregular, if desired.

The containers for conditioning materials are usually hollow and have wall thicknesses sufficient to prevent them from collapsing and to make them form-retaining or form-maintaining, the latter designation indicating that they are resilient enough to return to their initial shapes after being distorted in use. They may contain materials such as sponge, paper, cloth or other suitable absorbents, which may act to regulate the rate of release of conditioning liquid from the container. Also, they may contain weights to impart to them particular motions during tumbling, attributable to a shift in weight position, or such weights may be used to cause the tumbling container to contact with greater forces the materials to be treated. Normally, however, the containers will be hollow and of substantially regular wall thickness, generally from 0.1 cm. to 0.5 cm.

The dispensing container will have at least one dispensing opening and generally a plurality of these will be present. They may be regularly located at the container walls or in selected locations thereon, generally near the "top" thereof to prevent undesired leakage of conditioning liquid before intended use. When a plurality of multiplicity of openings is employed the number thereof will usually be from 4 to 100, preferably 10 to 50, and the areas of the openings, which may be same or different, will generally be from 0.0001 to 0.1 sq. cm., most often from 0.0005 to 0.01 sq. cm. and preferably will be from 0.005 to 0.05 sq. cm. in area. Although various shapes of openings may be used, the circular is preferred and the diameters of such circles will preferably be from 0.1 cm. to 0.2 cm. Instead of a plurality of openings, through which conditioning liquid is dispensed by gravity or capillary action upon contact of the liquid at the surface of the opening with the fibrous articles to be conditioned, or by the shock of contact with materials in a treating machine, such as the automatic laundry dryer, a spring controlled valve or other normally closed dispensing closure may be used, which opens periodically, by a timing device, in response to shocks or by other means. A container useful for the practice of this invention is illustrated in U.S. Pat. No. 2,941,309, wherein it is employed in the preparation of laundry for ironing.

The volume of the dispensing container will be chosen to be sufficient to hold the amount of conditioning liquid to be applied. When high dilutions of conditioning agents are desirably applied, to promote even application to the materials to be treated, larger volume containers will be employed. Correspondingly, when a plurality of dispensing containers is being used, when the load of materials to be treated is small and when the treating liquid is readily distributed over the surface of the materials to be treated, smaller containers may be utilized. The range of container sizes is wide and containers as small as ten cubic centimeters and as large as 2.5 liters can be used. Generally, it will be desirable to employ containers having a volume of from 50 c. cm. to 2 liters, preferably of 100 c. cm. to 1 liter.

Various methods for filling the dispensing container may be used. It may be immersed in the conditioning liquid until filled by displacement of air. It may be collapsed and allowed to expand to its original shape while immersed in the liquid. Preferably, a filling opening of larger diameter than the dispensing openings will be provided as illustrated in the drawing, to allow fast and convenient charging of the container with conditioning agent. The container is preferably transparent or transluscent so that the level of liquid therein may be observed and it may be provided with markings on the wall to indicate the content of conditioning liquid.

The liquid conditioning agent employed may be any suitable material and may be used for any suitable conditioning purpose, with respect to fibers, fabrics, manufactured articles or laundry to be treated. Thus, materials may be made water repellent, antibacterial, fungicidal, perfumed, brightened or bleached, but preferably the conditioning method involves softening fabrics and/or making them static-free and/or non-wrinkling. Agents for effecting these purposes may be in the liquid state under the conditions of application or may be dissolved in suitable solvents. They may contain additional compounds, such as solubilizing agents or release agents or they may be used alone. The solvents employed may be any suitable solvents, such as lower alcohols, esters, aldehydes, ketones or polyols, either alone or mixed with other solvents, such as water. However, water is the preferred solvent because of its good solubilizing effect, low cost, non-flammability and compatibility with conditioning agents. Of course, the solvents are not considered to be conditioning agents because they are readily removed from the "treated" fabrics by evaporation and have no lasting effects.

Among the preferred fabric softeners and antistatic agents are the nonionic surface active materials, including higher fatty acid mono-lower alkanolamides, higher fatty acid dilower alkanolamides, block copolymers of ethylene oxide and propylene oxide, having hydrophilic and lipophilic groups, alkyl (preferably middle alkyl) phenol poly-lower alkylene oxide lower alkanols, polymers of lower alkylene glycols, polyalkylene glycol ethers of higher fatty alcohols and polyalkylene glycol esters of higher fatty acids. Among the anionic agents are the higher fatty acid soaps of water soluble bases, higher fatty alcohol sulfates, higher fatty acid monoglyceride sulfates, sarcosides, taurides, isethionates and linear higher alkyl aryl sulfonates. Cationic compounds include the higher alkyl dilower alkyl amines, di-higher alkyl lower alkyl amines and quaternary compounds, especially quaternary ammonium salts, e.g., quaternary ammonium halides. In the preceding description, lower, as applied to various hydrocarbyl-containing groups, indicates a carbon content of from 1 to 6, preferably from 2 to 3. Similarly, higher includes compounds having from 10 to 20 carbon atoms, preferably from 12 to 18. Of course, since it is important to the present invention that the conditioning composition be in liquid form and dispensable through the apertures in the dispensing container wall, it will be chosen to form a desirable solution or liquid under dryer conditions. Flammable solvent contents will be limited in those embodiments involving the use of heat, as in conditioning effected in an automatic laundry dryer. Mixtures of nonionic conditioning agents with either cationics or anionics of the types mentioned above may also be used and generally, the proportions of components of such mixtures will be chosen so that they have the final product in most desired homogeneous liquid state, satisfactorily dispensable from the dispensing container during a tumbling operation with laundry or other fabrics to be treated.

Specific examples of surface active materials of the types described above are given in the text *Synthetic Detergents* by Schwartz, Perry and Berch, published in 1958 by Interscience Publishers, New York. See pages 25 to 143. Among the more preferred of these are:

Nonionic — nonylphenoxy polyethoxy ethanol; stearic monoethanolamide; stearic diethanolamide; block copolymers of ethylene oxide and propylene oxide (Pluronics);

Anionic — sodium soap of mixed coconut oil and tallow fatty acids; sodium stearate, potassium stearate; sodium laurate; tallow alcohols sulfate;

Cationic — distearyl dimethyl quaternary ammonium chloride; hydrogenated tallow alkyl trimethyl ammonium bromide and benzoethonium chloride.

The above list is only illustrative of some of the compounds useful in accordance with the present invention. Conditioning agents of these types are well known in the art and others than those mentioned above may also be used satisfactorily.

The concentration of conditioning agent, if a solution is employed, and the other properties of the conditioning agent used will be such as to result in a product of viscosity and surface characteristics which cause it to be dispensed at a desired rate from the container during the conditioning operation. Because they spread more readily over laundry being conditioned, the anionic and nonionic conditioning agents may generally be employed at higher concentrations than the highly substantive cationic softeners. Usually, in aqueous solutions the concentration of fabric softener will be from 0.05 to 20%, preferably from 0.1 to 10% and most preferably from 0.3 to 5%. The viscosity of such a solution will be from 0.2 to 10 centipoises, usually from 0.3 to 5 centipoises and is preferably from 0.5 to 3 centipoises. Viscosities in these ranges allow good dispensing through a plurality of openings of the sizes indicated previously. Rates of dispensing should be such that the liquid charge is delivered within about 2 to 50 minutes under use conditions. Usually, dispensing will be effected within 5 to 20 minutes. Dispensing will be gradual and at a substantially constant rate.

To prepare the conditioning article of the invention is a simple matter. It is only necessary to add the conditioning liquid to the article by any suitable method, peferably through an enlarged filling opening, after which the opening is sealed and the product is ready for use. If it is desired to prepare several conditioning articles from a solution of conditioning agent, they may all be filled and then kept cooled or frozen before use to prevent loss of dispensing liquid through the dispensing openings. Alternatively, they may be stored in plastic containers or have plastic skins formed about them to prevent leakage. Of course, if containers like those of FIGS. 2 and 6 are used, they will be filled to a level below the perforations and will be stored upright to prevent leakage. To use the conditioning article, it needs only to be added to an automatic laundry dryer or similar tumbling machine with materials to be conditioned. Means are provided for circulating heated air through the apparatus, which removes excess solvent while the conditioning agent is applied to the damp laundry. The temperature in the dryer is preferably from 50° to 90° C. and most preferably from 60° to 80° C., although in some circumstances heat may be omitted. The drying period is usually from 3 minutes to 2 hours and generally is from 15 minutes to 1 hour. Although the dryers of the horizontally rotating cylindrical drum type are preferred, other tumbling machines are also useful, as are similarly operative machines in which material to be conditioned is continually moved in the confined space.

The best amount of liquid softening composition to be employed and the weight of active ingredient therein can be established by experience with particular machines and loads of materials to be conditioned. As a general rule, from 1 to 100 grams of conditioning agent will be used per load of laundry to be conditioned. Such a load will generally be of from 2 to 4 kilograms.

A simple way of using the present invention is merely to add the dispensing container to the laundry being conditioned and allow it to tumble with the laundry. However, it is contemplated that dispensing containers of this type may also be held in place relative to parts of the interior of the washing machine or may be tethered to such parts, allowing restricted movement.

The various advantages of the present invention are to a large extent self-evident. Thus, a method is provided wherein non-substantive conditioning agents may be applied to fabrics to be treated. The conditioning agents do not have to be added in the wash water or in the final rinse and therefore, a housewife does not have to be at hand to stop the operation of her washing machine at a particular stage so that she can add the softener. Controlled application of softener is possible, since the volume thereof dispersed is ascertainable at any particular time during the operation of the dryer. Complex spraying devices are not needed to apply the conditioning agent to the laundry in the dryer and the expense thereof and possible inconvenience due to malfunctioning are avoided. The apparatus is simple to use and the method is easy to practice without requiring modifications of the dryer or adjustments of its normal drying cycles. The conditioning container is readily located after drying ceases and the maximum amount of conditioning agent applied to the laundry is controllable. An advantage over methods wherein waxy conditioning agents are employed in the dryer is in the absence of grease spots from the laundry being treated, which spots are sometimes observed with other dryer conditioning operations. The present apparatuses, rather than requiring special conditioning agents to be used, allow the use of fabric softeners which are now being sold at retail. Thus, additional savings to the consumer are made possible.

The following examples illustrate various embodiments of the invention. Unless otherwise indicated, all parts are by weight, temperatures are in degrees Centigrade and the measurements are in the metric system. The examples are not intended to limit the scope of the invention because it is evident that various modifications may be made and equivalents may be substituted without departing from the spirit thereof.

EXAMPLE 1

Aqueous solutions of various fabric softeners, most of which also possess antistatic and anti-wrinkling properties, are prepared at a variety of concentrations and are tested for softening utilities in dispensing containers of the present invention. One liter of each of the solutions made is filled into a hollow polyethylene sphere of the type illustrated in FIG. 2, containing 24 circular holes of an average diameter of about 0.13 cm. The holes are located in the upper portion of the ball, as is a filling opening. The ball is approximately 22 cm. in diameter and the opening is about 2 cm. in diameter.

After filling one liter portions of conditioning solutions into the ball, the operation of the dispenser is tested in a practical conditioning test conducted in a commercial electric automatic laundry dryer of the horizontal axis tumbling drum type. In some tests gas dryers are also used. In such a test, a front loading clothes dryer is partially filled with damp laundry to be dried, the dispensing container of conditioning agent solution is placed in the dryer and drying is commenced.

The laundry treated is a mixture of wearing apparel and household articles, totaling eight pounds, including cotton, synthetic fibers, especially polyesters, polyacetates and blends of these plastics with each other or with cotton, nylons, rayons and resin-treated, permanently pressed and wrinkle resistant fabrics. The wash comprises approximately 50% of cotton articles, 20% of polyester-cotton blends, 10% permanently pressed items, 10% nylon articles and the balance of rayon, acetate, etc. The laundry to be conditioned occupies 40% of the dryer volume and the drying air is blown through the dryer at the rate of about 200 cubic feet per minute, at an initial temperature of about 70° C. The drum rotates at about a speed of 60 r.p.m. Initially the temperature of the damp laundry is low, approximately 20° C., but as drying continues, it increases to almost 70° C.

The conditioning agent solution is dispensed from the container onto the surfaces of the fabrics being treated, as the container is brought into contact with the fabrics and is subjected to the shocks of movement in the dryer. The dispensing is usually complete within about 2 to 40 minutes and generally within from 5 to 20 minutes. After 50 minutes of drying the machine is turned off and the laundry is removed. It is found to be soft to the touch and static-free, compared to a similar load in which the conditioning article is not employed. The clothing treated has no oily or greasy spots or stains on it. After consumption of the conditioning solution, the dispenser may be re-filled and used again. In some cases, where less conditioning is required, the automatic laundry dryer operation is halted temporarily before complete dispensing of the contents of the conditioning device and then the article is removed. To condition the eight pounds of mixed laundry charged, it has been found that from 0.5 to 100 grams of conditioning agent may be used but generally from about 1 to 10 grams and preferbly from 1 to 5 grams thereof will usually be sufficient.

The following table describes the softening effects obtained.

TABLE 1

| Conditioning agent | Trade Name | Concentration (%, Active Ingredient Basis) | pH | Softening Effect |
|---|---|---|---|---|
| Tallow alcohol sulfate | | 1.0 | | good |
| Coconut oil diethanolamide, modified | Varamide A10 | 5.0 | 9.1 | fair |
| Nonionic softener | Emersoft 7777 | 5.0 | 4.6 | good |
| Nonionic softener | Emersoft 7780 | 5.0 | 4.2 | good |
| Dimethyl stearylamine oxide | Aromox DM18W | 1.0 | 6.3 | good |
| 1-methyl 1-alkyl amidoethyl-2-alkyl imidazolium methosulfate | Culversoft S-75 | 0.3 | 4.7 | good |
| Same | Same | 0.5 | 4.6 | Excellent |
| Same | Same | 1.0 | 3.9 | good |
| Same | Same | 2.0 | 3.8 | Excellent |
| Same | Same | 3.0 | 3.7 | Excellent |
| Same | Same | 4.0 | 3.9 | Excellent |
| Dimethyl di-hydrogenated tallow alkyl ammonium chloride | Arquad 2HT | 0.3 | 5.4 | good |
| Same | Same | 2.0 | 5.3 | excellent |
| Same | Same | 5.0 | 5.3 | excellent |
| Amphoteric softener | Miranol SHD Conc. | 0.3 | 11.3 | fair |

When, in place of the various softening agents shown in the table, other water soluble softeners are employed, generally as water soluble salts but also, in some cases, with additional solvents, such as alcohol, or solubilizing agents or emulsifiers, the solutions produced, employed within the described concentration ranges, also give useful softening conditioning of the test laundry. In some cases a slight staining is observed upon close inspection but usually by downward adjustment of the concentration of conditioning agent this can be avoided. When other concentrations are employed, within the 0.05 to 20% range, the total volume of the conditioning solution dispensed is adjusted so that the conditioner applied is from 0.5 to 100 grams per laundry load, preferbly from 1 to 5 grams thereof. Also, although it is preferred to employ a dispenser such as that disclosed, which discharges its contents within a time of from 2 to 10 minutes under normal operation, adjustments of dispensing times are made outside the range and good results are obtainable. Finally, when the dispensing openings are large enough so that material drips from them, without contact with the fabric and resulting capillary action or without shocking of the container by movement within the dryer, care is taken so that when the container is inserted it is immediately started in motion before it has the opportunity to dispense substantial quantities of conditioning agents to isolated portions of the laundry being treated, which can cause staining or spotting.

In addition to excellent softening of the laundry, it is noted that in most cases it is also made static-free and unwrinkled. In some circumstances, other conditioning agents are usable with the softeners, e.g., bactericides, perfumes, brighteners, and these further improve the properties of the fabrics treated.

EXAMPLE 2

Instead of employing the article illustrated in FIG. 2, that of FIG. 1 is used and is filled with the same solutions described in Table 1, above. Substantially the same results are obtained and such good conditioning also results by utilizing the other dispensers illustrated, of larger or smaller sizes within the described range of volumes. When 2% of propylene glycol and 5% of ethanol are also present, better solubilities are observed with some of the conditioning agents. When the laundry treated is not simultaneously dried but is dried subsequently, the same conditioning effects are observed. However, when initially dry materials are treated, the results may not be as good in some cases and therefore, it is usually desirable to dampen the laundry before treatment. Of course, such dampening can be effected during treatment too, either by separate addition of water or by using a more dilute treating solution.

The use of normally liquid conditioning agents or gels in pure concentrated forms in the dispensing container can sometimes cause appearances of spots or stains on the treated articles, due to an excess of such waxy or oily materials being deposited on the items being treated. Nevertheless, by control of the dispenser and dryer conditions so that the discharge rate is held down and the temperature is kept just about at the flow point of such materials, good conditioning is obtainable. Generally, however, it is preferred to employ solvents to dissolve or emulsifiers to suspend such materials, to avoid staining. Also, sponges, cloths, paper or other absorbent materials are sometimes placed in the interiors of the dispensing containers to limit the rates of flow of conditioners through the openings. These are useful for the dispensing of either dissolved or melted softeners and additionally, perform a distributing function when applied over the containers' outer surfaces.

When the conditioning article or dispensing container is held to a dryer wall and the laundry tumbles against it as it releases conditioning solution, good conditioning effects are also obtained, providing that the dispensing openings are adjacent to the laundry at the time of contact or release. If the openings are so located as to cause a flow of conditioner solution down a dryer wall, control should be exercised to prevent pooling of the solution before application to the laundry to avoid overconcentrations thereof on the articles being conditioned. If this is done and contacts with bare metal parts are avoided, staining is prevented and good softening is obtained.

What is claimed is:

1. An apparatus for softening laundry during the drying thereof which comprises an automatic laundry dryer of the substantially horizontally rotating tumbling drum type, having means for heating air and means for circulating such air through the tumbling laundry and having therein a fabric softening article which comprises a dispensing container for a liquid fabric softening composition, which container has a plurality of permanent and unvalved openings of cross-sectional areas in the range of 0.001 to 0.1 sq. cm. over at least a portion of the surface thereof, through which liquid fabric softening composition is gradually dispensable during tumbling of the container in contact with laundry to be softened during operation of the automatic laundry dryer, and a liquid fabric softening composition in the container which includes a softening agent selected from the group consisting of surface active synthetic organic anionic, nonionic, cationic, anionic-nonionic and cationic-nonionic fabric softening agents and is of a viscosity in the range of about 0.3 to 5 centipoises.

2. An apparatus according to claim 1 wherein the fabric softening article is substantially spherical in its shape, of a volume of 100 c. cm. to one liter and of a material of construction selected from the group consisting of polypropylene and polyethylene and has a multiplicity of dispensing openings of cross-sectional areas in the range of 0.005 to 0.05 sq. cm. over the surface thereof and a larger sealable filling opening, the dispensing openings being of such size that, unless the container is contacted with laundry to be softened and is subjected to shocks associated with tumbling in the operation of the automatic laundry dryer, the tumbling in the operation of the automatic laundry dryer, the surface tension and viscosity of the softener solution, in combination with the sizing of the dispensing openings, will prevent dispensing of the solution through such openings and the liquid fabric softening composition is an aqueous solution comprising from 0.1 to 10% of fabric softener.

3. A method of softening laundry which comprises tumbling the laundry in an apparatus according to claim 1 at a temperature of 50° to 90° C. for a period of three minutes to two hours until the laundry is dried and softened.

4. A method according to claim 3 wherein the apparatus is that of claim 2.

* * * * *